US007938394B2

(12) United States Patent
Chino

(10) Patent No.: US 7,938,394 B2
(45) Date of Patent: May 10, 2011

(54) RECORDING MEDIUM FEEDING DEVICE AND RECORDING APPARATUS

(75) Inventor: Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 12/405,377

(22) Filed: Mar. 17, 2009

(65) Prior Publication Data

US 2009/0236791 A1 Sep. 24, 2009

(30) Foreign Application Priority Data

Mar. 18, 2008 (JP) ..... 2008-069332

(51) Int. Cl.
*B65H 3/44* (2006.01)

(52) U.S. Cl. ..... 271/9.11; 271/162

(58) Field of Classification Search ..... 271/9.01, 271/9.11, 162
See application file for complete search history.

(56) References Cited

U.S. PATENT DOCUMENTS 7,212,751 B2 * 5/2007 Kayama et al. ..... 399/21

FOREIGN PATENT DOCUMENTS

| | | |
|---|---|---|
| JP | 02-231331 | 9/1990 |
| JP | 2005-314103 | 11/2005 |
| JP | 2007-223756 | 9/2007 |
| JP | 2007-223757 | 9/2007 |
| JP | 2007-223758 | 9/2007 |

* cited by examiner

*Primary Examiner* — Michael C McCullough
(74) *Attorney, Agent, or Firm* — Workman Nydegger

(57) ABSTRACT

A recording medium feeding device includes a recording medium cassette that is detachable from a main body and a recording medium retracting unit that retracts a recording medium lying on a recording medium feeding path back to the recording medium cassette. The recording medium cassette includes a lower tray that accommodates a recording medium, and an upper tray that accommodates a recording medium and is provided to be slidable with respect to the lower tray along a transport direction of the recording medium. The recording medium feeding device is provided with a unit for performing a retracting operation of the recording medium using the recording medium retracting unit in accordance with sliding of the upper tray in the transport direction.

5 Claims, 6 Drawing Sheets

RECORDING MEDIUM FEEDING DEVICE AND RECORDING APPARATUS

BACKGROUND

1. Technical Field

The present invention relates to a recording medium feeding device including a recording medium cassette that is detachable from a main body and a recording medium retracting unit that retracts a recording medium lying on a recording medium feeding path back to the recording medium cassette. In addition, the invention relates to a recording apparatus including the recording medium feeding device, as represented by a facsimile, a printer, and the like.

2. Related Art

In the related art, a paper cassette detachable from a main body has been widely used. An example of such a paper cassette is a 2-stage detachable paper cassette (tray) having paper accommodating portions at lower and upper stages thereof. JP-A-2-231331 and JP-A-2007-223758 are examples of the related art. Such paper accommodating portions for accommodating a stack of paper in a recording apparatus have various names, for example, "cassette" and "tray". However, in the following description, one unit detachable from a main body is referred to as "cassette", and a plurality of paper accommodating portions provided in the cassette are referred to as "trays".

In a recording apparatus, sheets of paper to be transported out of a paper cassette, particularly, sheets of paper to be double transported, may be transported along on a paper feeding path by a separation unit for preventing a double transport of paper sheets. When an upper tray is slid toward an abutting position (use position) in a state where a sheet of paper transported out of a lower tray is lying on a paper feeding path in a recording apparatus having a 2-stage paper cassette, the sheet of paper transported out of the lower tray sometimes becomes jammed between the upper tray and the main body or between the upper tray and the lower tray.

In such a case, it is very difficult to retract the sheet of paper drawn out of the lower tray back to the lower tray. As a result, a sheet of paper cannot be fed from the upper tray (non-feeding problem), or double transport may easily occur (double feeding problem).

SUMMARY

An advantage of some aspects of the invention is that a sheet of paper drawn out of a lower tray is prevented from being jammed by an upper tray when using particularly the upper tray of a paper cassette having a multi-stage tray structure, and further non-feeding and double feeding problems when transporting sheets of paper out of the upper tray are prevented.

According to an aspect of the invention, a recording medium feeding device includes: a recording medium cassette that is detachable from a main body; and a recording medium retracting unit that retracts a recording medium lying on a recording medium feeding path back to the recording medium cassette, wherein the recording medium cassette includes a lower tray that accommodates a recording medium, and an upper tray that accommodates a recording medium and is provided to be slidable with respect to the lower tray along a transport direction of the recording medium, and wherein the recording medium feeding device is provided with a unit for performing a retracting operation of the recording medium using the recording medium retracting unit in accordance with sliding of the upper tray in the transport direction.

With such a configuration, since the unit for performing the retracting operation of the recording medium by the recording medium retracting unit in accordance with the sliding of the upper tray in the transport direction is provided, the recording medium is drawn out of the lower tray when the upper tray is slid in the recording medium transport direction. Accordingly, even when the recording medium is lying on the recording medium feeding path, it is expected that the recording medium is retracted to the lower tray by the recording medium retracting unit before the recording medium is jammed between the upper tray and the main body of the feeding device or between the upper tray and the lower tray. Therefore, it is possible to reliably feed the recording medium, without non-feeding and double feeding problems when the recording medium is fed from the upper tray.

In the recording medium feeding device, it is preferable that the unit for performing the retracting operation of the recording medium using the recording medium retracting unit in accordance with the sliding the upper tray in the transport direction is provided with a first engagement portion that is engageable with the upper tray, a second engagement portion that is engageable with the recording medium retracting unit, a swing member that is swingable with respect to the main body, and it is preferable that the retracting operation of the recording medium by the recording medium retracting unit is performed in a manner that the upper tray is slid in the transport direction to engage the first engagement portion with the upper tray and to swing the swing member, thereby engaging the second engagement portion with the recording medium retracting unit.

With such a configuration, since the recording medium retracting unit can be operated by the swing operation of the swing member, the unit for performing the retracting operation of the recording medium by the recording medium retracting unit in accordance with the sliding of the upper tray in the transport direction can be made in a simple structure with low costs.

In the recording medium feeding device, it is preferable that a front inner wall of the lower tray in the transport direction and a front inner wall of the upper tray in the transport direction have a pectinated shape so that the front inner walls engage with each other when the upper tray is at an abutting position where the upper tray is completely inserted in the transport direction, and it is preferable that the unit for performing the retracting operation of the recording medium by the recording medium retracting unit in accordance with the sliding of the upper tray in the transport direction performs the retracting operation before the front inner wall of the lower tray and the front inner wall of the upper tray engage with each other in the course of sliding the upper tray toward the abutting position.

With such a configuration, the front inner wall of the lower tray and the front inner wall of the upper tray are configured to engage with each other when the upper tray is at the abutting position, and the retracting operation is performed before the front inner wall of the lower tray and the front inner wall of the upper tray engage with each other. Accordingly, even when the recording medium is being drawn out of the lower tray, it is possible to prevent the recording medium from being jammed between the front inner wall of the lower tray and the front inner wall of the upper tray.

In the recording medium feeding device, it is preferable that the recording medium retracting unit is provided with a retracting member that is capable of taking a withdrawn posture of being withdrawn from the recording medium feeding path, and a forward posture of being advanced toward a sliding area of the upper tray when the recording medium transported out of the lower tray is retracted to the lower tray, and the recording medium retracting unit performs the retracting operation by changing the retracting member from the withdrawn posture to the forward posture, and it is preferable that the unit for performing the retracting operation of the recording medium by the recording medium retracting unit in accordance with the sliding of the upper tray in the transport direction withdraws the retracting member from the sliding area of the upper tray before the upper tray enters an operation area of the retracting member in the course of sliding the upper tray toward the abutting position.

With such a configuration, the retracting member is withdrawn from the sliding area of the upper tray before the upper tray enters the operation area of the retracting member in the course of sliding the upper tray toward the abutting position. Accordingly, it is possible to normally operate the retracting member by preventing interference between the upper tray and the retracting member.

According to another aspect of the invention, a recording apparatus includes a printing unit that records on a recording medium; and the recording medium feeding device that feeds the recording medium. In this case, it is possible to obtain the same advantages as the above-described operation effects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
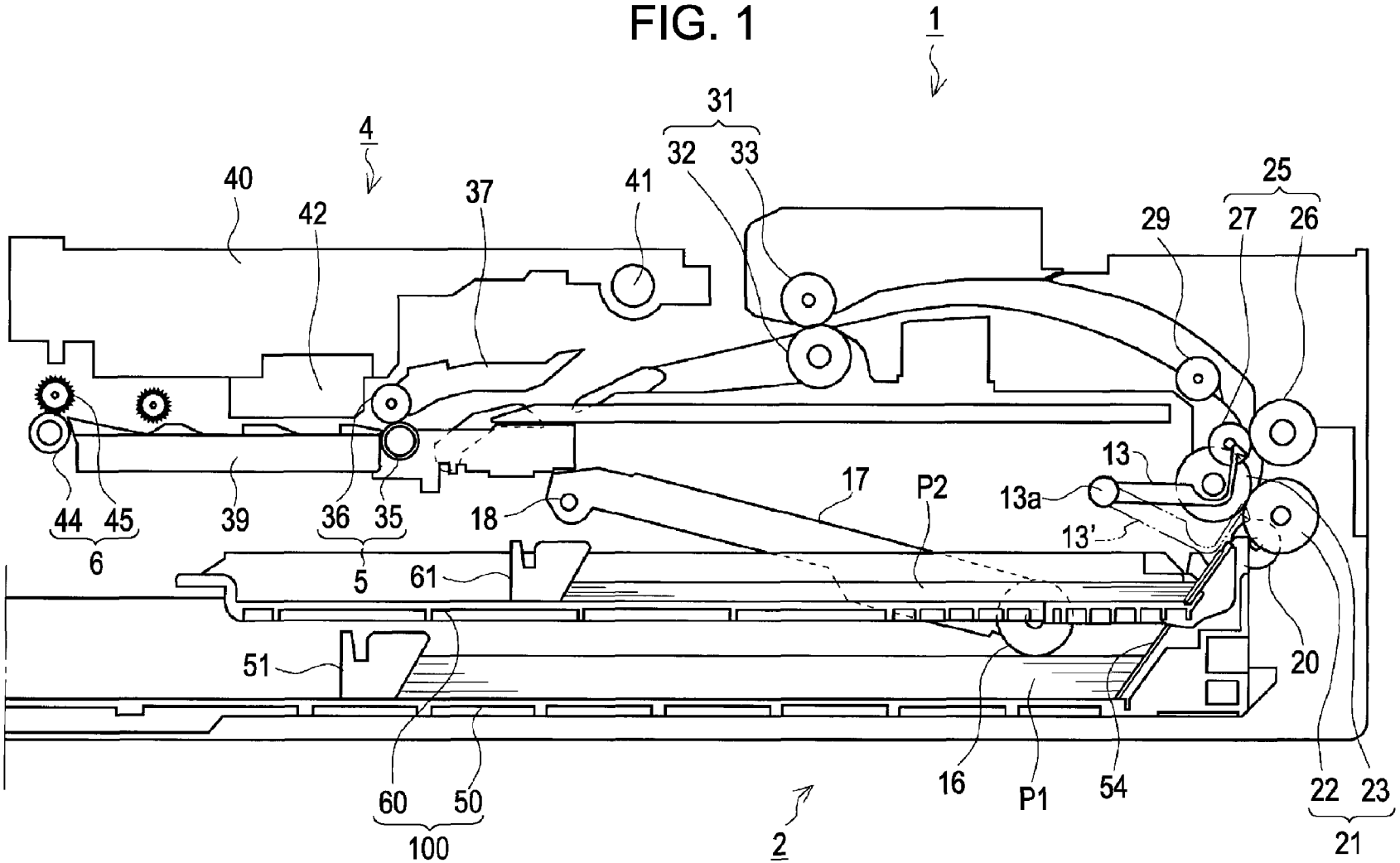
FIG. 1 is a side cross-sectional view illustrating a paper transport path of a printer according to an embodiment of the invention.
Figure 2:
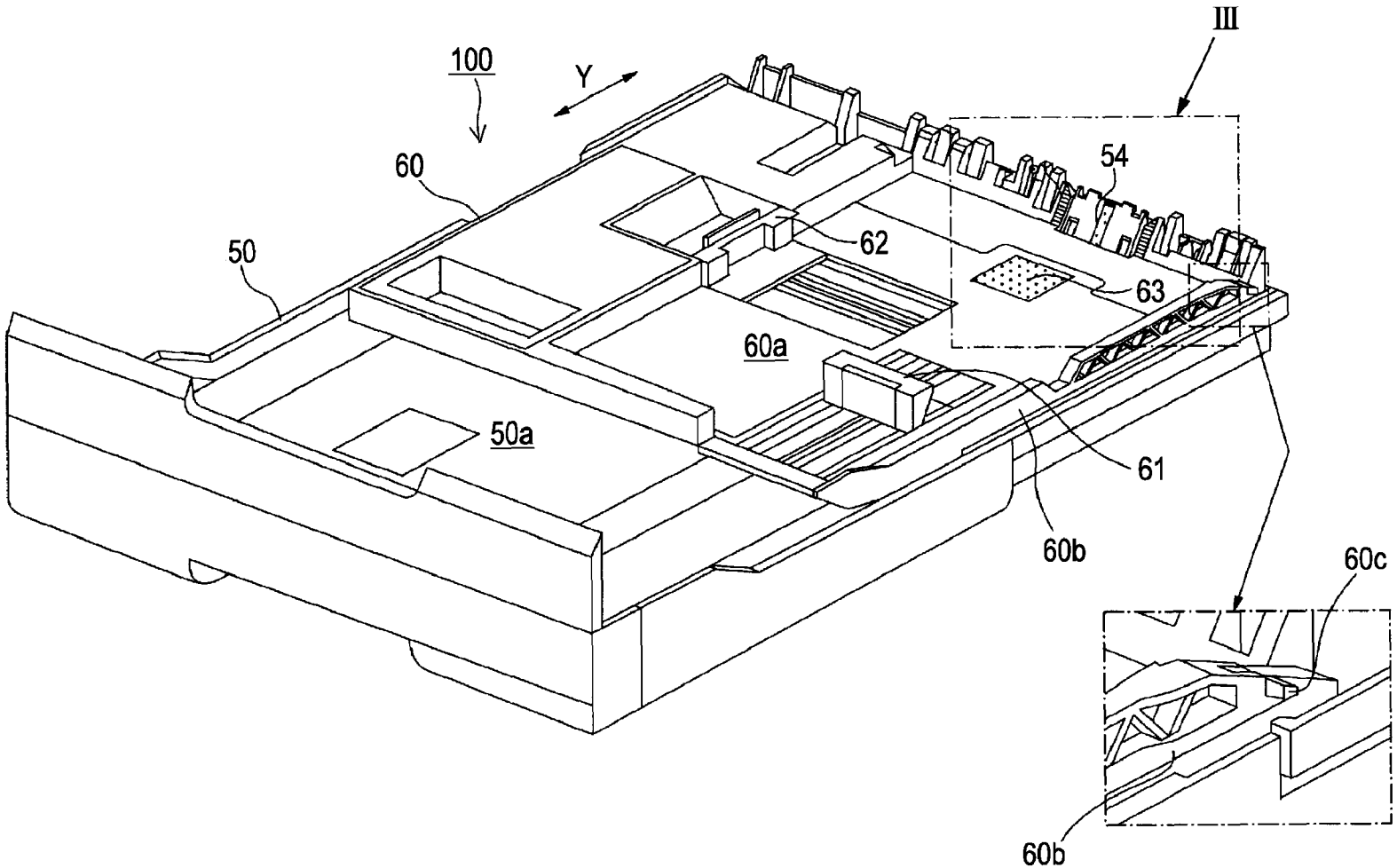
FIG. 2 is a perspective view illustrating a paper cassette according to the invention.
Figure 3:
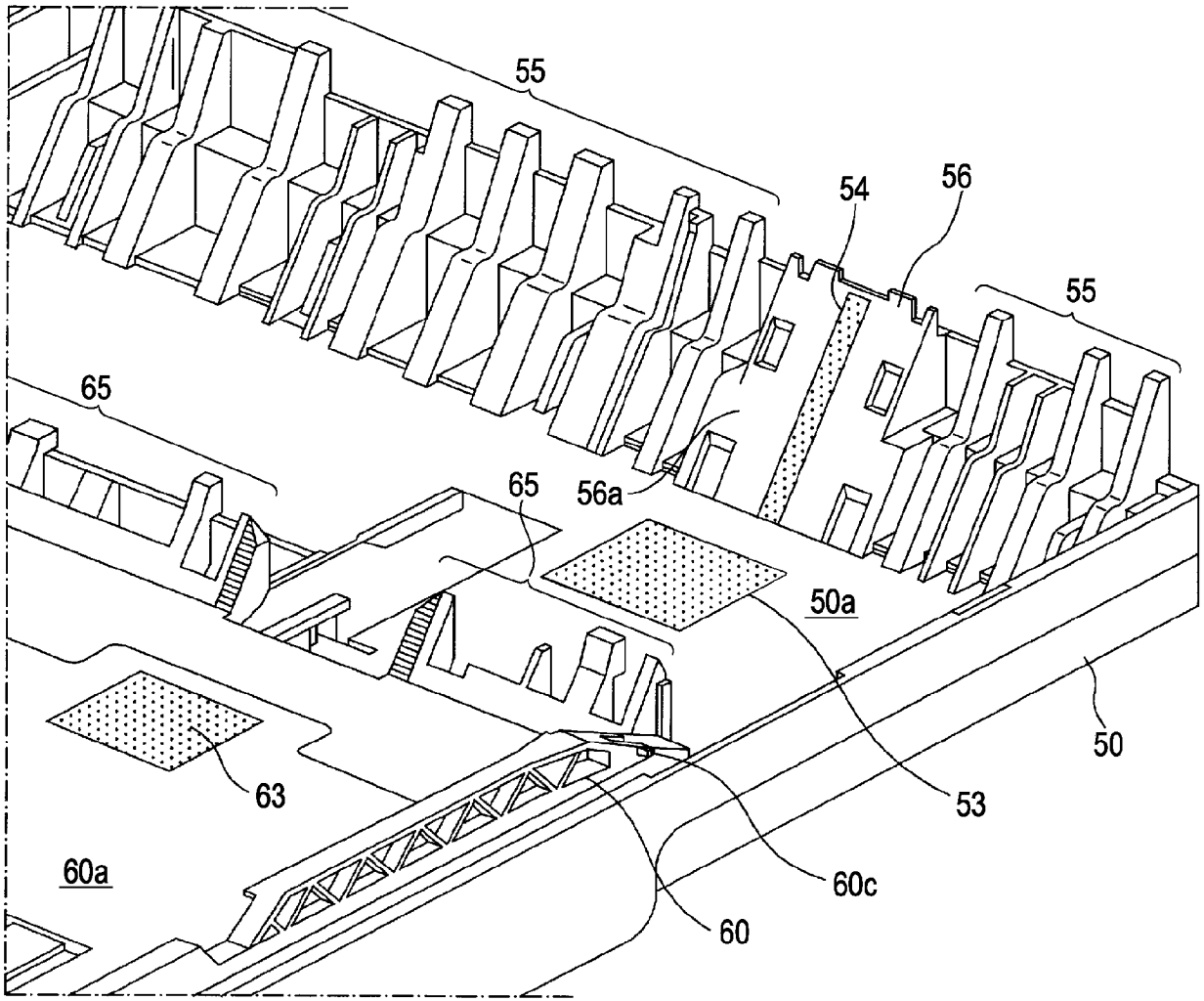
FIG. 3 is a partial enlarged view illustrating the paper cassette according to the invention.
Figure 4:
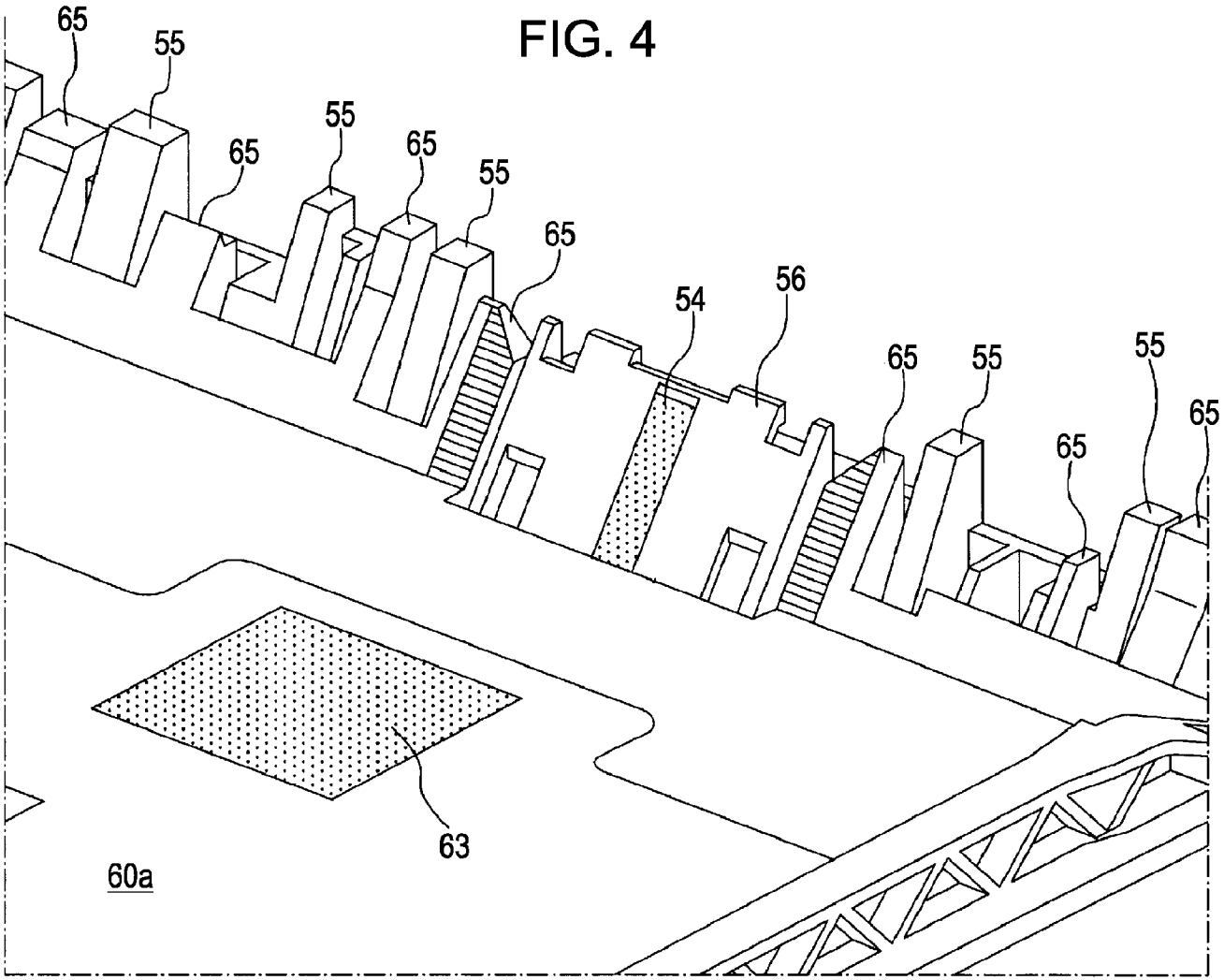
FIG. 4 is a perspective view illustrating a state of slightly withdrawing an upper tray from an abutting position where the upper tray is completely inserted in a paper transport direction.

An embodiment of the invention will be described hereinafter with reference to FIG. 1 to FIG. 6B. FIG. 1 is a side cross-sectional view illustrating a paper transport path of an ink jet printer (hereinafter, referred to as a printer) 1 that is an embodiment of a recording apparatus. FIG. 2 is a perspective view illustrating a paper cassette 100 according to the invention. FIG. 3 is a partially enlarged perspective view (enlarged view of a part III in FIG. 2) illustrating the paper cassette 100. FIG. 4 is a perspective view illustrating a state of slightly withdrawing an upper tray 60 from an abutting position where the upper tray 60 is completely inserted in a paper transport direction.

Figure 5:
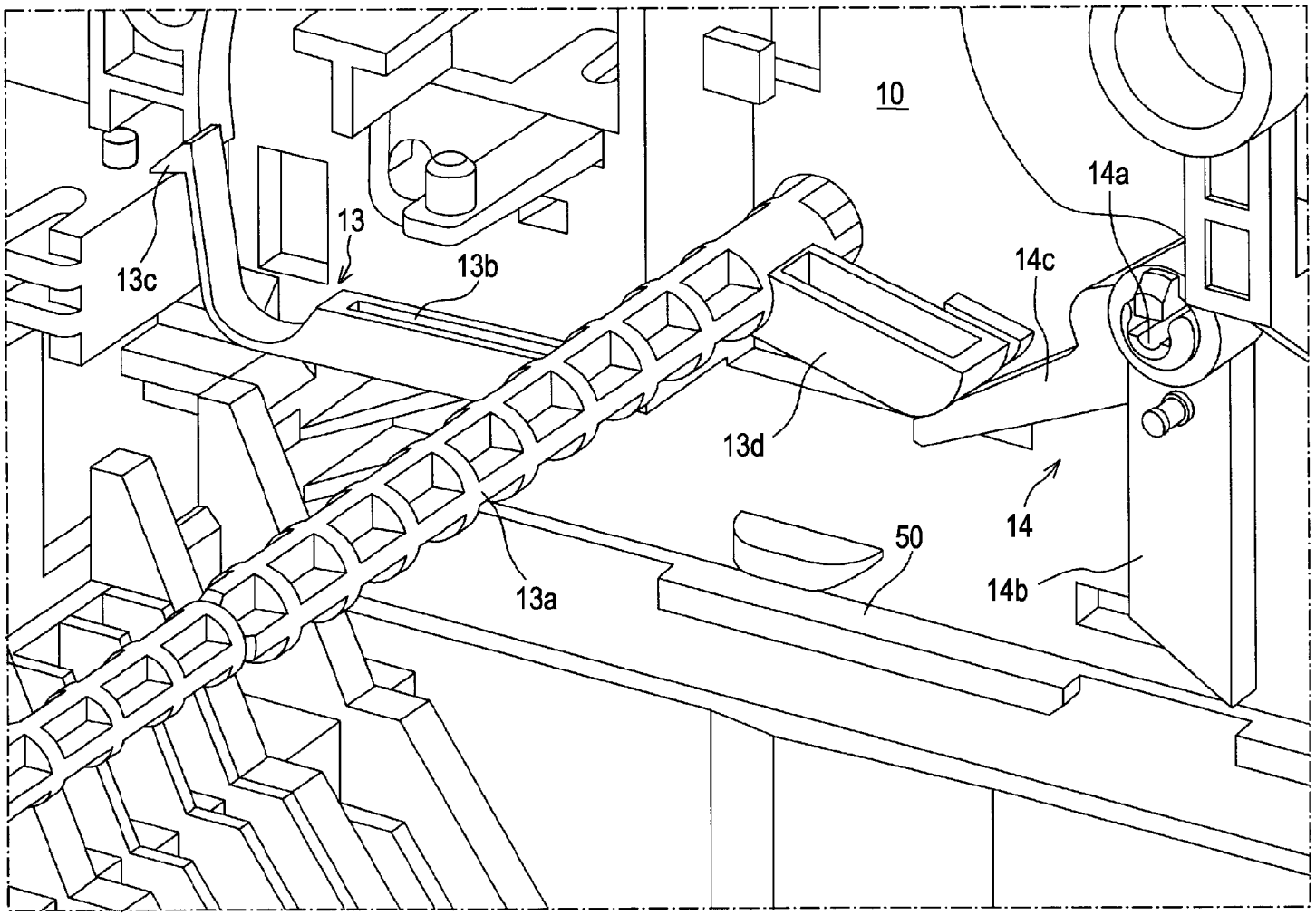
FIG. 5 is a perspective view illustrating a state of mounting a retracting lever constituting a retracting lever operating unit.
Figure 6A:
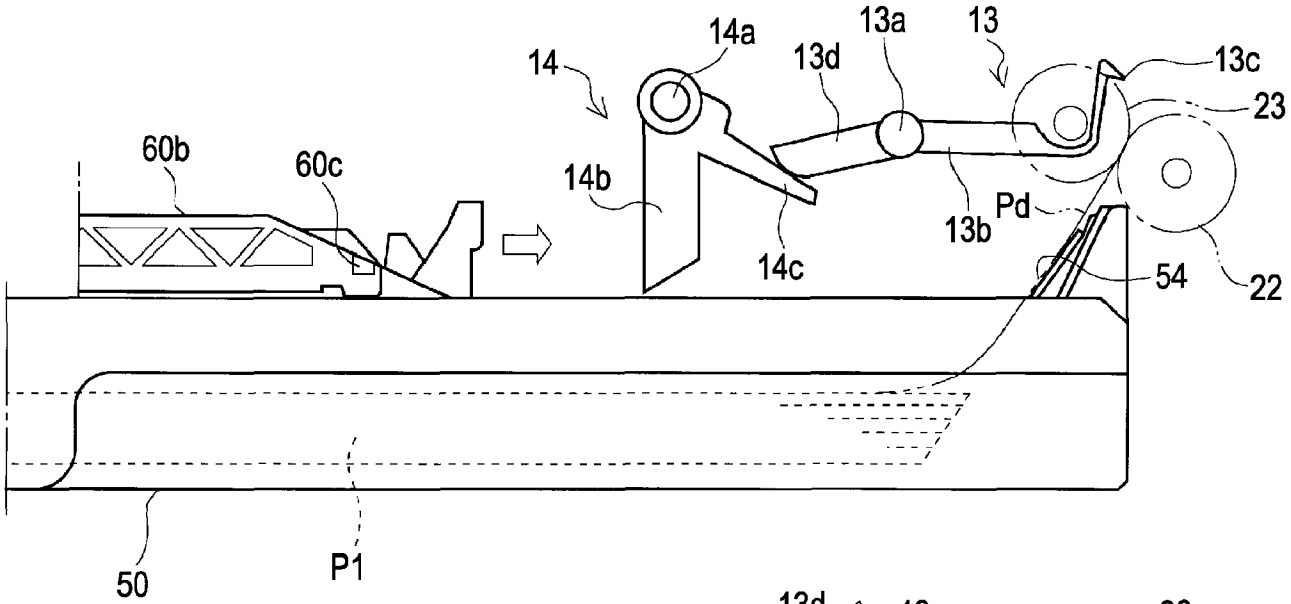
FIG. 6A is a view illustrating a disengagement state between an upper tray and a swing member.
Figure 6B:
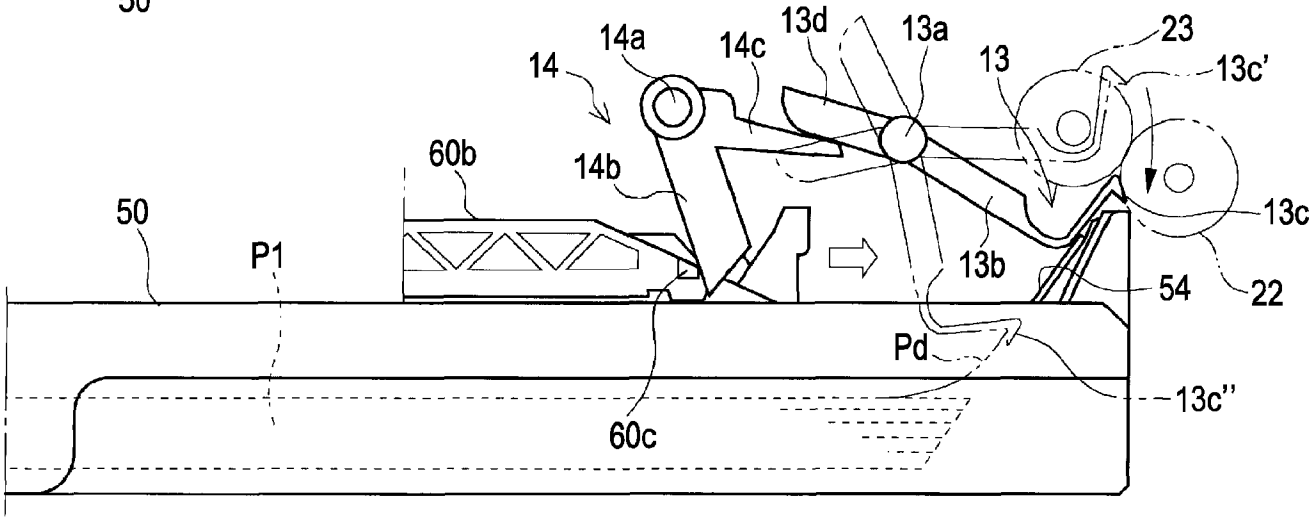
FIG. 6B is a view illustrating an engagement state between an upper tray and a swing member.

FIG. 5 is a perspective view illustrating a state of mounting a swing member 14 constituting a retracting lever operating unit. FIG. 6A and FIG. 6B are side views of the paper cassette 100 and the swing member 14. FIG. 6A is a view illustrating a disengagement state between the upper tray 60 and the swing member 14, and FIG. 6B is a view illustrating an engagement state between the upper tray 60 and the swing member 14.

In FIG. 1, although almost all rollers disposed on the paper transport path of the printer 1 are shown on the same plane, the positions of the rollers may not coincide with each other in a depth direction (front and back surface direction of FIG. 1).

An overall configuration of the printer 1 will be described hereinafter with reference to FIG. 1. The printer 1 is provided with a feeding device 2 at a lower portion thereof and is configured such that sheets of paper (mainly, a single sheet of paper; hereinafter, referred to as sheet of paper P) as an example of the recording medium are fed one by one from the feeding device 2, a printing unit 4 records (ink jet recording), and the sheets of paper are discharged toward a discharge stacker (not shown) provided on the front side (right side in FIG. 1) of the printer 1.

Constituent elements on the paper transport path will be described hereinafter in more detail. The feeding device 2 is provided with a paper cassette 100, a pickup roller 16, a guide roller 20, and a separation unit 21. The paper cassette 100 capable of setting a plurality of sheets of paper P in a stacked state can be attached to and detached from the front side of a main body of the feeding device 2, and is provided with two paper accommodating portions of a lower tray 50 disposed on the lower side thereof and an upper tray 60 disposed on the upper side thereof.

In FIG. 1, Reference Numeral P1 denotes sheets of paper accommodated in the lower tray 50, and Reference Numeral P2 denotes sheets of paper accommodated in the upper tray 60 (hereinafter, referred to as sheet of paper P when particular distinction is not necessary).

The pickup roller 16 rotated by a motor (not shown) is provided at a swing member 17 swinging with respect to a swing shaft 18. In a state where the upper tray 60 is completely inserted toward the back side (left side in FIG. 1), the pickup roller 16 is rotated in contact with the top sheet of paper P1 accommodated in the lower tray 50, thereby transporting the top sheet of paper P1 from the lower tray 50.

At the abutting position where the upper tray 60 is completely inserted toward the front side (right side in FIG. 1), the pickup roller 16 is rotated in contact with the top sheet of paper P2 accommodated in the upper tray 60, thereby transporting the top sheet of paper P2 from the upper tray 60.

A friction separation material 54 is disposed to form an open angle with respect to a paper stacking direction (inclined to open upward) at a position facing a leading end of the sheets of paper P1 set in the lower tray 50 or a position facing a leading end of the sheets of paper P2 set in the upper tray 60 at the paper transporting time. The leading end of the sheets of paper P transported by the rotation of the pickup roller 16 comes into contact with the friction separation material 54 and is advanced toward the downstream side, thereby being preliminary separated from the next sheet of paper P.

The freely rotatable guide roller 20 is provided on the downstream side of the friction separation material 54, and a separation unit 21 including a separation roller 22 and a driving roller 23 is provided on the downstream side of the guide roller 20. The separation roller 22 has an outer peripheral surface formed of an elastic material and is provided so as to be in press contact with the driving roller 23 with a predetermined rotation resistance given thereto by a torque limiter. Accordingly, the next sheet of paper P to be double transported is stopped between the separation roller 22 and the driving roller 23, that is, the double transport is prevented. In addition, the driving roller 23 is rotated by a motor (not shown) in a direction of transporting the sheet of paper P to the downstream side.

A retracting lever (retracting member) 13 that constitutes a recording medium retracting unit and performs a swing operation with respect to a swing shaft 13*a* by a driving motor (not shown) or a retracting lever operating unit is disposed in the vicinity of the separation unit 21.

The leading end of the sheet of paper P to be fed passes through a space between the separation roller 22 and the driving roller 23, and then the retracting lever 13 swings as shown from a solid line to a chain double-dashed line 13', thereby retracting the next sheet of paper P lying between the separation roller 22 and the driving roller 23 back to the paper cassette 100. In FIG. 1, the state of the retracting lever represented by Reference Numeral 13' does not show the maximum swing posture in a clockwise direction.

Then, a first intermediate transport portion 25 including a driving roller 26 rotated by a motor (not shown) and an assist roller 27 nipping the sheet of paper P between the driving roller 26 and the assist roller 27 and rotated by the driving roller 26 is provided on the downstream side of the separation unit 21, and the sheet of paper P is transported further toward the downstream side by the first intermediate transport portion 25.

The printer 1 is provided with a curved reverse path for curving and reversing the sheet of paper P transported out of the paper cassette 100 to reverse the transport direction thereof, and a driven roller 29 for reducing a paper passing load when the sheet of paper P passes through the curved reverse path (particularly, when the trailing end of the sheet of paper P passes therethrough) is provided on the downstream side of the first intermediate transport portion 25.

A second intermediate transport portion 31 including a driving roller 32 rotated by a motor (not shown) and an assist roller 33 nipping the sheet of paper P between the driving roller 32 and the assist roller 33 and driven by the driving roller 32 is provided on the downstream side of the driven roller 29, and the sheet of paper P is transported further toward the downstream side by the second intermediate transport portion 31.

The printing unit 4 is disposed on the downstream side of the second intermediate transport portion 31. The printing unit 4 is provided with a transport unit 5, a printing head 42, a front paper guide 39, and a discharge unit 6. A paper detecting unit (not shown) for detecting the passing of the sheet of paper P is provided in the vicinity of the upstream side of the transport unit 5.

The transport unit 5 is provided with a driving transport roller 35 rotated by a motor and a driven transport roller 36 shaft-connected to an upper paper guide 37 so as to come into press contact with the driving transport roller 35 and be driven by the driving transport roller 35. The sheet of paper P reaching the transport unit 5 is precisely transported toward the downstream side by rotating the driving transport roller 35 with the sheet of paper P nipped by the driving transport roller 35 and the driven transport roller 36.

The printing head 42 is provided under a carriage 40, the carriage 40 is guided by a carriage guide shaft 41 extending in a main scanning direction (front and back surface direction of FIG. 1) while the carriage 40 is driven to reciprocate in the main scanning direction by a driving motor (not shown). The carriage 40 is of a so-called off-carriage type mounting no ink cartridge. An ink cartridge (not shown) is provided independently from the carriage 40, and ink is supplied from the ink cartridge through an ink supply tube (not shown) to the printing head 42.

The front paper guide 39 is provided at a position facing the printing head 42, and a distance between the sheet of paper P and the printing head 42 is regulated by the front paper guide 39. The discharge unit 6 for discharging the recorded sheet of paper P is provided on the downstream side of the front paper guide 39. The discharge unit 6 is provided with a driving discharge roller 44 rotated by a motor (not shown) and a driven discharge roller 45 rotated in contact with the driving discharge roller 44. The sheet of paper P on which the printing operation is performed by the printing unit 4 is discharged to a stacker (not shown) provided on the front side of the printer 1 by the discharge unit 6.

The outline of the printer 1 has been described above, and the paper cassette 100 will be described in detail hereinafter with reference to FIG. 2 to FIG. 6B, and FIG. 1 as necessary. The lower tray 50 is provided with an edge guide 51 (see FIG. 1) slidable in the paper transport direction (i.e., paper length direction), and a position of a rear edge is regulated using the edge guide 51, on a bottom 50*a* thereof. In addition, an edge guide (not shown) slidable in a direction (i.e., paper width direction) perpendicular to the paper transport direction is provided, and a position of a side edge is regulated using the edge guide.

A high friction material 53 is disposed at a position corresponding to a contact position between the pickup roller 16 and the sheet of paper P1, on the bottom 50*a* (see FIG. 4). A stack of paper is held by the high friction material 53, so as not to transport the stack of paper to the downstream side at the time of transporting each sheet of paper by the pickup roller 16.

As shown in FIG. 3 and FIG. 4, a front inner wall of the lower tray 50 in the paper transport direction is configured by a pectinated portion 55 including a plurality of rib-shaped elements disposed at appropriate intervals along the paper width direction (direction perpendicular to the paper transport direction), and a separation material holding portion 56, a position of which in the paper width direction coincides with positions of the pickup roller 16 and the high friction material 53.

Although a surface facing the paper leading end in the pectinated portion 55 has an oblique shape extending obliquely upward to form an open angle from the bottom 50*a* in the paper stacking direction, the pectinated portion 55 has a step shape extending once substantially parallel to and in the paper transport direction in the way thereof and obliquely extending upward again. The separation material holding portion 56 is formed so as to be substantially oblique to the bottom 50*a* and to have the same inclination angle as the pectinated portion 55, has no step shape unlike the pectinated portion 55, and extends upward so as to be substantially straight and oblique to the bottom 50*a*.

The separation material holding portion 56 is provided with a friction separation material 54 forming a separation oblique surface, and the paper leading end comes into contact with the friction separation material 54 and proceeds toward the downstream side at the paper feeding time, thereby being separated from the next sheet of paper.

Similarly with the lower tray 50, the upper tray 60 is provided with an edge guide 61 slidable in the paper length direction, and an edge guide 62 slidable in the paper width direction, on the bottom 60*a* thereof. A high friction material 63 is disposed at a position corresponding to a contact position between the pickup roller 16 and the sheet of paper P2.

A front inner wall of the upper tray 60 in the paper transport direction is configured by a pectinated portion 65 including a plurality of rib-shaped elements disposed at appropriate intervals along the paper width direction. A position of the pectinated portion 65 is set in the paper width direction so that the pectinated portion 65 engages with the pectinated portion 55 and the separation material holding portion 56 of the lower tray 50, at the abutting position where the upper tray 60 is completely inserted in the paper transport direction. A surface facing the paper leading end in the pectinated portion 65 is oblique to the bottom 60*a* and extends upward to form an open angle in the paper stacking direction.

In the state where the upper tray 60 configured as described above is positioned at the abutting position, the friction separation material 54 of the lower tray 50 protrudes closer to the leading end of the sheets of paper accommodated in the upper tray 60 than the front inner wall (pectinated portion 65) of the upper tray 60 as shown in FIG. 5B, and thus the friction separation material 54 is used as a separation unit when the sheets of paper is transported out of the upper tray 60. That is, the friction separation material 54 of the lower tray 50 is used as a common separation unit of the lower tray 50 and the upper tray 60.

A unit (retracting lever operating unit) for performing a paper retracting operation by the retracting lever 13 in accordance with sliding of the upper tray 60 in the paper transport direction will be described with reference to FIG. 5, FIG. 6A, and FIG. 6B.

The retracting lever 13 is provided with a first arm portion 13*b* extending in a direction perpendicular to an axial line of the swing shaft 13*a*, and a pawl portion 13*c* formed at the end thereof. The swing shaft 13*a* is provided with a second arm portion 13*d* extending in the direction perpendicular to the axial line of the swing shaft 13*a*. The first arm portion 13*b*, the pawl portion 13*c*, the swing shaft 13*a*, and the second arm portion 13*d* are integrally formed of resin.

The retracting lever 13 swings to take a withdrawn posture (see FIG. 6A) of being withdrawn from the paper feeding path and a forward posture (see FIG. 6B, Reference Numeral 13*c*") of being advanced toward the paper feeding path, and is urged toward the withdrawn posture by an urging unit (not shown). The retracting lever 13 swings from the withdrawn posture toward the forward posture by a driving motor and cam mechanism (not shown) at the paper transporting time, thereby performing the paper retracting operation of retracting the sheet of paper lying at the separation unit 21 to the paper cassette 100. When the paper retracting operation is completed, the retracting lever 13 swings to return from the forward posture to the withdrawn posture by the urging force of the urging unit.

Then, the retracting lever operating unit for performing the paper retracting operation by the retracting lever 13 in accordance with the sliding of the upper tray 60 in the paper transport direction is provided independently from the unit for operating the retracting lever 13 at the paper feeding time as described above, and is provided with the swing member 14.

The swing member 14 is provided to be swingable with respect to the swing shaft 14*a* inside an opening portion receiving the paper cassette 100 in a frame 10 constituting the main body of the feeding device 2, and is provided with a first arm portion 14*b* extending from the swing shaft 14*a* and a second arm portion 14*c*.

As shown in FIG. 2, a right side wall 60*b* of the upper tray 60 is provided with an engagement protrusion 60*c* protruding sideward, and the engagement protrusion 60*c* is engageable with the first arm portion 14*b* of the swing member 14. Accordingly, when the upper tray 60 is slid toward the abutting position as shown in FIG. 6A, the engagement protrusion 60*c* provided on the right side wall 60*b* of the upper tray 60 pushes the first arm portion 14*b* up, thereby swinging the swing member 14 in a counterclockwise direction shown in FIG. 6A and FIG. 6B.

At this time, the second arm portion 14*c* of the swing member 14 engages with the second arm portion 13*d* provided at the swing shaft 13*a* of the retracting lever 13, thereby swinging the retracting lever 13 in a clockwise direction shown in FIG. 6A and FIG. 6B, against the urging force of the urging unit for urging the retracting lever 13 toward the withdrawn posture. Accordingly, as shown in FIG. 6B, the paper retracting operation is performed by the retracting lever 13.

The operation effects of the retracting lever operating unit configured as described above will be described in detail. The paper cassette 100 has a multi-stage structure having the lower tray 50 and the upper tray 60. However, when the upper tray 60 is slid toward the abutting position (use position) in the state where the sheet of paper P1 transported out of the lower tray 50 is lying on the paper feeding path, a sheet of paper (represented by Reference Numeral Pd in FIG. 6A) being drawn out of the lower tray 50 is jammed between the upper tray 60 and the lower tray 50.

In such a state, it is difficult to retract the sheet of paper being drawn out of the lower tray 50 back to the lower tray 50. As a result, the sheets of paper cannot be fed from the upper tray 60 (non-feeding problem), or double transport very easily occurs (double feeding problem).

However, since the feeding device 2 is provided with the retracting lever operating unit (swing member 14) performing the paper retracting operation by the retracting lever 13 in accordance with the sliding of the upper tray 60 in the paper transport direction as described above, it is possible to retract the sheet of paper back to the lower tray 50 before the sheet of paper is jammed between the upper tray 60 and the lower tray 50, even when the sheet of paper is drawn out of the lower tray 50 and is lying on the paper feeding path. Therefore, it is possible to reliably feed the sheet of paper, without non-feeding and double feeding problems when the sheet of paper is fed from the upper tray 60.

When the swing operation is performed by the swing member 14, the retracting lever 13 in the embodiment is advanced to the sliding area of the upper tray 60 represented by Reference Numeral 13" in FIG. 6B in the forward posture. Accordingly, the sheet of paper lying on the paper feeding path is reliably retracted to the lower tray 50. However, when the upper tray 60 is slid toward the abutting position in such a forward posture of the retracting lever 13, the upper tray 60 interferes with the operation returning to the withdrawn posture of the retracting lever 13.

In the swing member 14 according to the embodiment, the shapes (lengths, open angles of both, etc.) of the first arm portion 14*b* and the second arm portion 14*c* are set to withdraw the retracting lever 13 from the sliding area of the upper tray 60 before the upper tray 60 enters the operation area of the retracting lever 13 in the course of sliding the upper tray 60 toward the abutting position. Accordingly, the inference between the upper tray 60 and the retracting lever 13 is prevented, and thus it is possible to normally operate the retracting lever 13.

What is claimed is:

1. A recording medium feeding device comprising:

a recording medium cassette that is detachable from a main body; and a first recording medium retracting unit that retracts a recording medium lying on a recording medium feeding path back to the recording medium cassette, wherein the recording medium cassette includes a lower tray that accommodates the first recording medium which is to be fed toward the recording medium feeding path where a recording operation is performed on the first recording medium, and an upper tray that accommodates a second recording medium which is to be fed toward the recording medium feeding path where a recording operation is performed on the second recording medium, and which is provided to be slidable with respect to the lower tray along a transport direction of the first and second recording mediums, and wherein the recording medium feeding device is provided with a unit for performing a retracting operation of the first recording medium using the recording medium retracting unit in accordance with sliding of the upper tray in the transport direction.

2. The recording medium feeding device according to claim 1, wherein the unit for performing the retracting operation of the first recording medium using the recording medium retracting unit in accordance with the sliding of the upper tray in the transport direction is provided with a first engagement portion that is engageable with the upper tray, a second engagement portion that is engageable with the recording medium retracting unit, and a swing member that is swingable with respect to the main body, and wherein the retracting operation of the first recording medium by the recording medium retracting unit is performed in a manner that the upper tray is slid in the transport direction to engage the first engagement portion with the upper tray and to swing the swing member, thereby engaging the second engagement portion with the recording medium retracting unit.

3. The recording medium feeding device according to claim 1, wherein a front inner wall of the lower tray in the transport direction and a front inner wall of the upper tray in the transport direction have a pectinated shape so that the front inner walls engage with each other when the upper tray is at an abutting position where the upper tray is completely inserted in the transport direction, and wherein the unit for performing the retracting operation of the first recording medium by the recording medium retracting unit in accordance with the sliding of the upper tray in the transport direction performs the retracting operation before the front inner wall of the lower tray and the front inner wall of the upper tray engage with each other in the course of sliding the upper tray toward the abutting position.

4. The recording medium feeding device according to claim 3, wherein the recording medium retracting unit is provided with a retracting member that is capable of taking a withdrawn posture of being withdrawn from the recording medium feeding path, and a forward posture of being advanced toward a sliding area of the upper tray when the first recording medium transported out of the lower tray is retracted to the lower tray, and the recording medium retracting unit performs the retracting operation by changing the retracting member from the withdrawn posture to the forward posture, and wherein the unit for performing the retracting operation of the recording medium by the recording medium retracting unit in accordance with the sliding of the upper tray in the transport direction withdraws the retracting member from the sliding area of the upper tray before the upper tray enters an operation area of the retracting member in the course of sliding the upper tray toward the abutting position.

5. A recording apparatus comprising:

a printing unit that records on a recording medium; and the recording medium feeding device that feeds the first and second recording mediums according to claim 1.

* * * * *